US008152567B2

(12) United States Patent
Wu et al.

(10) Patent No.: US 8,152,567 B2
(45) Date of Patent: Apr. 10, 2012

(54) ELECTRICAL CONNECTOR HAVING A PADDLE BOARD WITH A TRANSFORMER WITH A MAGNETIC CORE EMBEDDED IN THE PADDLE BOARD

(75) Inventors: Li-Chun Wu, Tu-Cheng (TW); Chao-Tung Huang, Tu-Cheng (TW); Yong-Chun Xu, Kunshan (CN); Jian-She Hu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 99 days.

(21) Appl. No.: 12/786,463

(22) Filed: May 25, 2010

(65) Prior Publication Data

US 2010/0297882 A1 Nov. 25, 2010

(30) Foreign Application Priority Data

May 25, 2009 (TW) ..... 98117316

(51) Int. Cl.
*H01R 13/66* (2006.01)

(52) U.S. Cl. ..... 439/620.06

(58) Field of Classification Search ..... 439/620.06, 439/620.11, 620.12, 620.15–620.19, 620.05, 439/38–41

See application file for complete search history.

(56) References Cited

U.S. PATENT DOCUMENTS 5,781,091 A 7/1998 Krone et al.
6,926,558 B2 8/2005 Sasai et al.
7,153,163 B2 * 12/2006 Lewis et al. ..... 439/620.11
7,670,183 B2 * 3/2010 Huang et al. ..... 439/620.05
7,708,594 B2 * 5/2010 Xu ..... 439/620.05
7,708,595 B2 * 5/2010 Chow et al. ..... 439/620.15
7,749,027 B2 * 7/2010 Chow et al. ..... 439/620.15
7,785,135 B2 * 8/2010 Wu ..... 439/490
7,841,902 B2 * 11/2010 Chow et al. ..... 439/620.15
7,901,216 B2 * 3/2011 Rohrbach et al. ..... 439/39
7,993,163 B2 * 8/2011 Wu et al. ..... 439/620.06
2003/0211782 A1 11/2003 Esparaz et al.
2007/0063807 A1 3/2007 Quilici
2007/0111598 A1 5/2007 Quilici
2008/0186124 A1 8/2008 Schaffer et al.
2008/0224811 A1 9/2008 Wang
2009/0002111 A1 1/2009 Harrison et al.
2009/0176408 A1 7/2009 Wu

* cited by examiner

*Primary Examiner* — Chandrika Prasad

(74) *Attorney, Agent, or Firm* — Ming Chieh Chang; Wei Te Chung; Andrew C. Cheng

(57) ABSTRACT

A modular jack connector (100) includes a contact module (2) having a paddle board (22) formed with two conductive sections (28*b*). The contact module includes two transformers (24) each including a magnetic core (271) embedded in the paddle board, and a number of PCB layout traces distributed in the paddle board and including a first group of PCB layout traces having one group of tips extending to a position adjacent to corresponding magnetic core to form a magnetic field and another group of tips connected to the conductive section, and a second group of PCB layout traces having one group of tips extending to a position adjacent to corresponding magnetic core to form a magnetic field and another group of tips connected to the vias. The common mode chokes are surface mounted on the conductive section.

11 Claims, 7 Drawing Sheets

ELECTRICAL CONNECTOR HAVING A PADDLE BOARD WITH A TRANSFORMER WITH A MAGNETIC CORE EMBEDDED IN THE PADDLE BOARD

CROSS-REFERENCE TO RELATED APPLICATIONS

This patent application is related to a pending U.S. patent application Ser. No. 12/769,686, filed on Apr. 29, 2010, and entitled "MODULAR JACK CONNECTOR HAVING IMPROVED MAGNETIC MODULE", which is assigned to the same assignee with this application.

BACKGROUND OF THE INVENTION

1. Field of the Invention

The present invention relates to a modular jack connector, and more particularly to a modular jack connector having improved magnetic module having improved characteristics under a simple configuration.

2. Description of Related Art

U.S. Patent Application Publication No. 2009/0176408 published on Jul. 9, 2009 discloses an electrical connector comprising an insulative housing defining a cavity, a contact module received in the insulative housing, a shielding cage mounted on the insulative housing. The contact module comprises a paddle board having a first and a second side faces, a plurality of contacts mounted at the first side face of the paddle board and electrically connected with the paddle board, a plurality of magnetic modules mounted on the second side face of the paddle board, and a converting module carrying a plurality of converting contacts mounted at the second side face of the paddle board. The paddle board has a plurality of through holes extending through the first and second side faces. The converting contacts of the converting module are inserted through the through holes. The magnetic module comprises a magnetic core and a plurality of wires winding around the magnetic core.

The magnetic module is formed by winding a plurality of coils around a magnetic core. Such a magnetic module is then soldered to the paddle board directly or through a base with conductive pins.

U.S. Patent Application Publication No. 2008/0186124 published on Aug. 7, 2008 discloses a wire-less inductive device. The inductive device comprises a magnetic core embedded in top and bottom headers or substrates, a plurality of through-hole vias or a plurality of connecting elements disposed around the magnetic core.

U.S. Patent Application Publication No. 2007/0111598 published on May 17, 2007 discloses a receptacle assembly having a substrate and a plurality of electrical components, e.g., magnetic elements, resistive elements, capacitive elements disposed on the substrate.

Hence, a modular jack connector having improved magnetic module is highly desired.

SUMMARY OF THE INVENTION

Accordingly, an object of the present invention is to provide a modular jack connector having an improved magnetic module taking less space and having improved characteristics.

In order to achieve the object set forth, a modular jack connector in accordance with the present invention includes an insulative housing defining a receiving cavity, a contact module received in the receiving cavity of the insulative housing. The contact module includes a paddle board having opposite first and second conductive layers and an insulative layer sandwiched between the first and second conductive layers. The first conductive layer is formed with two conductive sections. The paddle board defines a plurality of vias extending therethrough. The contact module includes two transformers, a number of contact terminals and a converting module. The transformer includes a magnetic core embedded in the paddle board, and a number of PCB layout traces distributed in the paddle board and including a first group of PCB layout traces having one group of tips extending to a position adjacent to corresponding magnetic core to form a magnetic field and another group of tips connected to the conductive section, and a second group of PCB layout traces having one group of tips extending to a position adjacent to corresponding magnetic core to form a magnetic field and another group of tips connected to the vias. The common mode chokes are surface mounted on the conductive section. The contact terminals are attached to the second conductive layer of the paddle board. The converting module is secured to the first conductive layer of the paddle board and having a number of converting terminals inserting through said vias.

The transformers are embedded in the paddle board via PCB layout traces to improve filter effect. The common mode chokes are surface mounted on the paddle board to save space. The filter circuit capable of reducing noise interference has been established in the modular jack connector only via the paddle board only. Such a contact module has a simple configuration, takes less space and is able to obtain improved characteristics.

Other objects, advantages and novel features of the invention will become more apparent from the following detailed description when taken in conjunction with the accompanying drawings.

DETAILED DESCRIPTION OF THE PREFERRED EMBODIMENT

Figure 2:
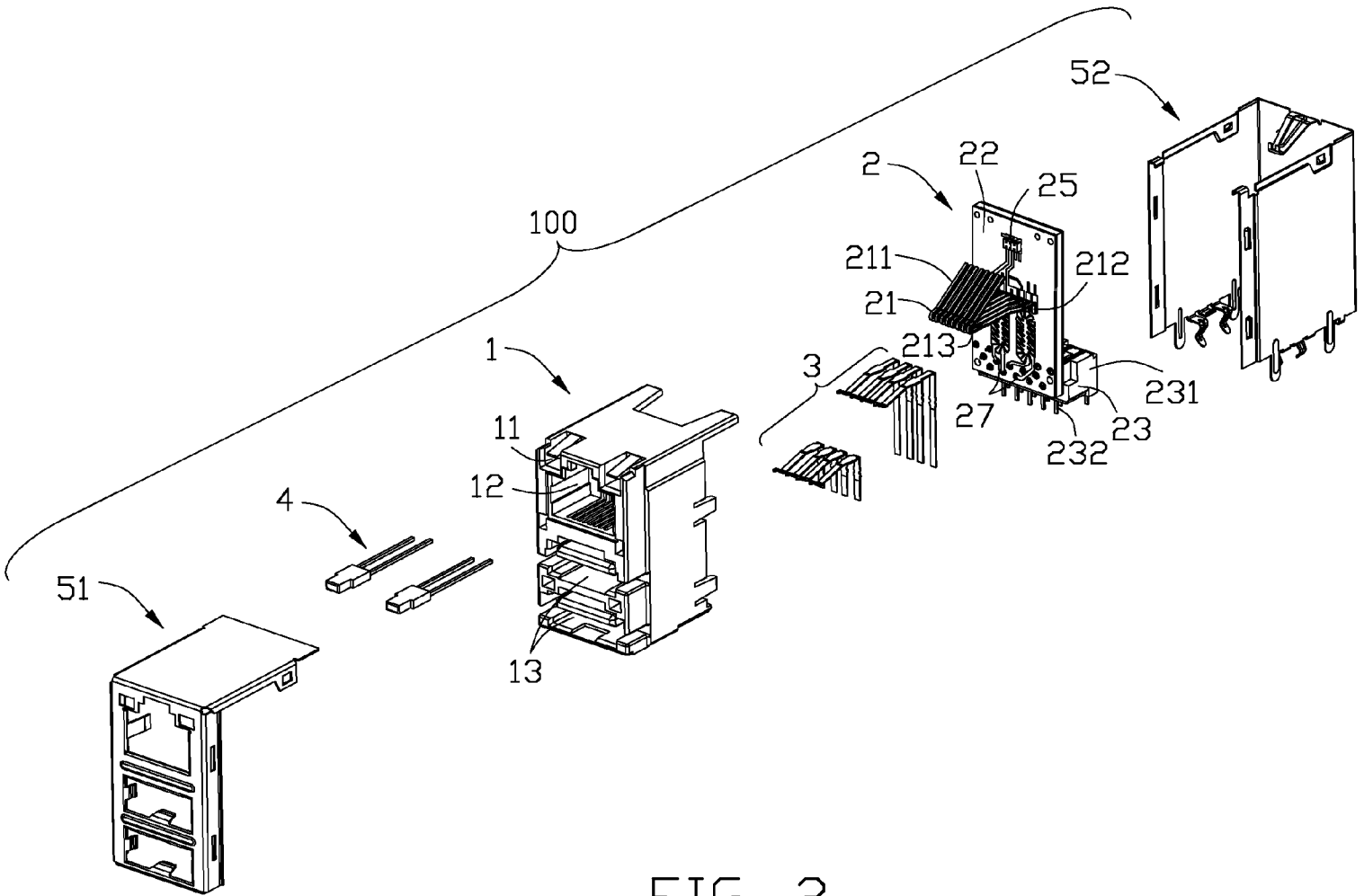
FIG. 2 is an exploded perspective view showing the modular jack connector.
Figure 3:
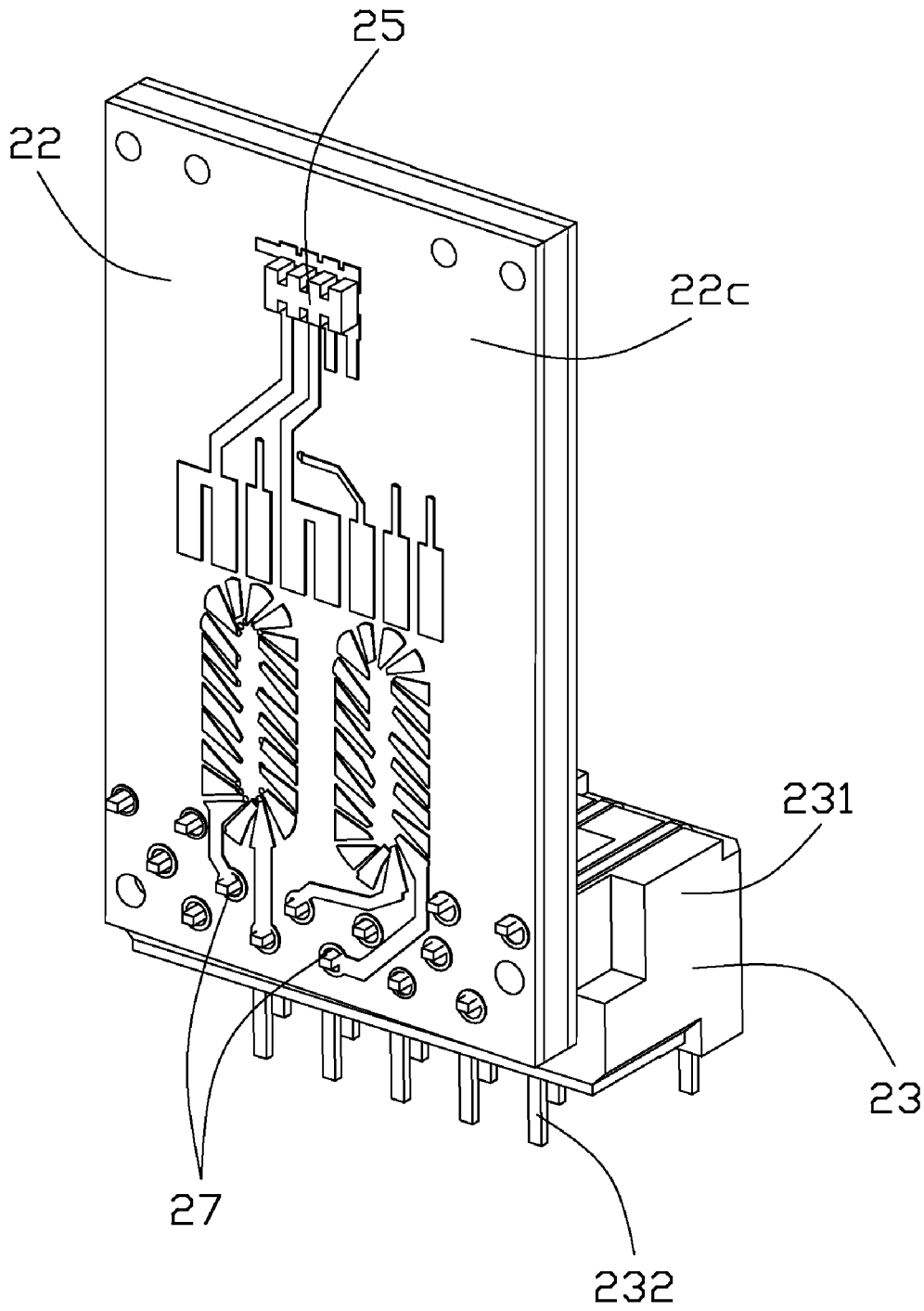
FIG. 3 is an assembled perspective view showing a contact module of the modular jack connector.
Figure 4:
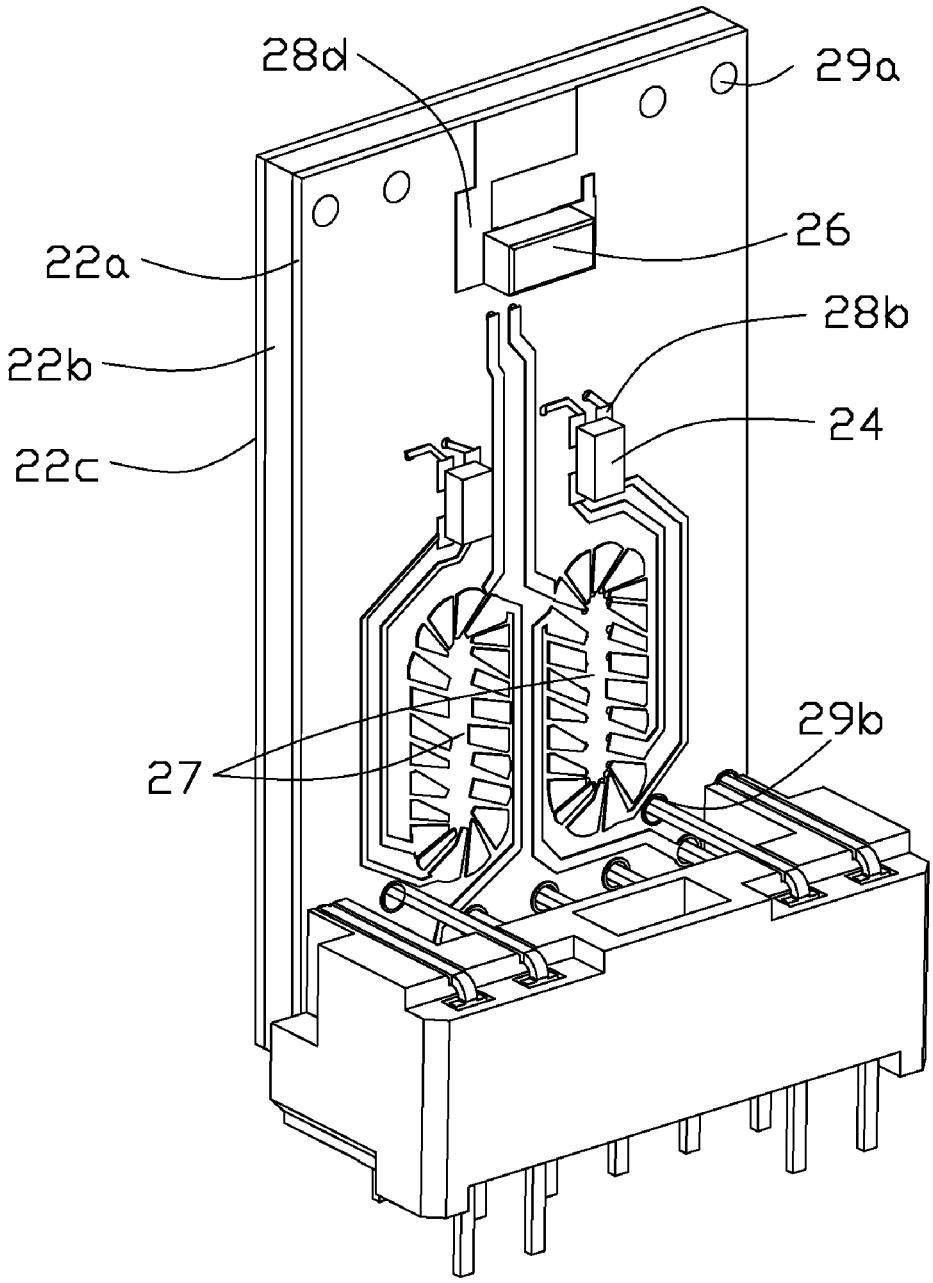
FIG. 4 is a view similar to FIG. 3, taken from another aspect.
Figure 5:
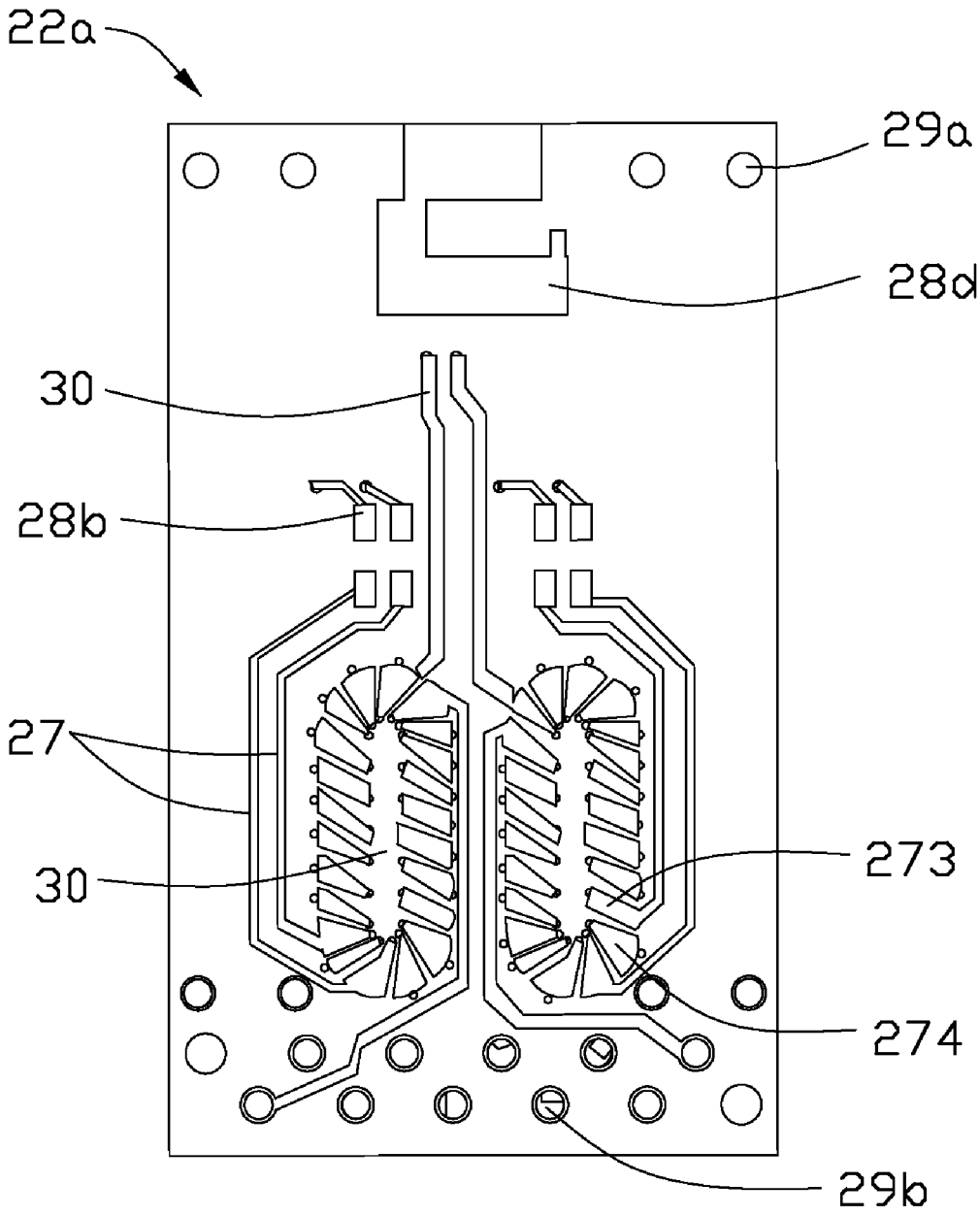
FIG. 5 is a schematic view showing a first conductive layer of the paddle board.
Figure 6:
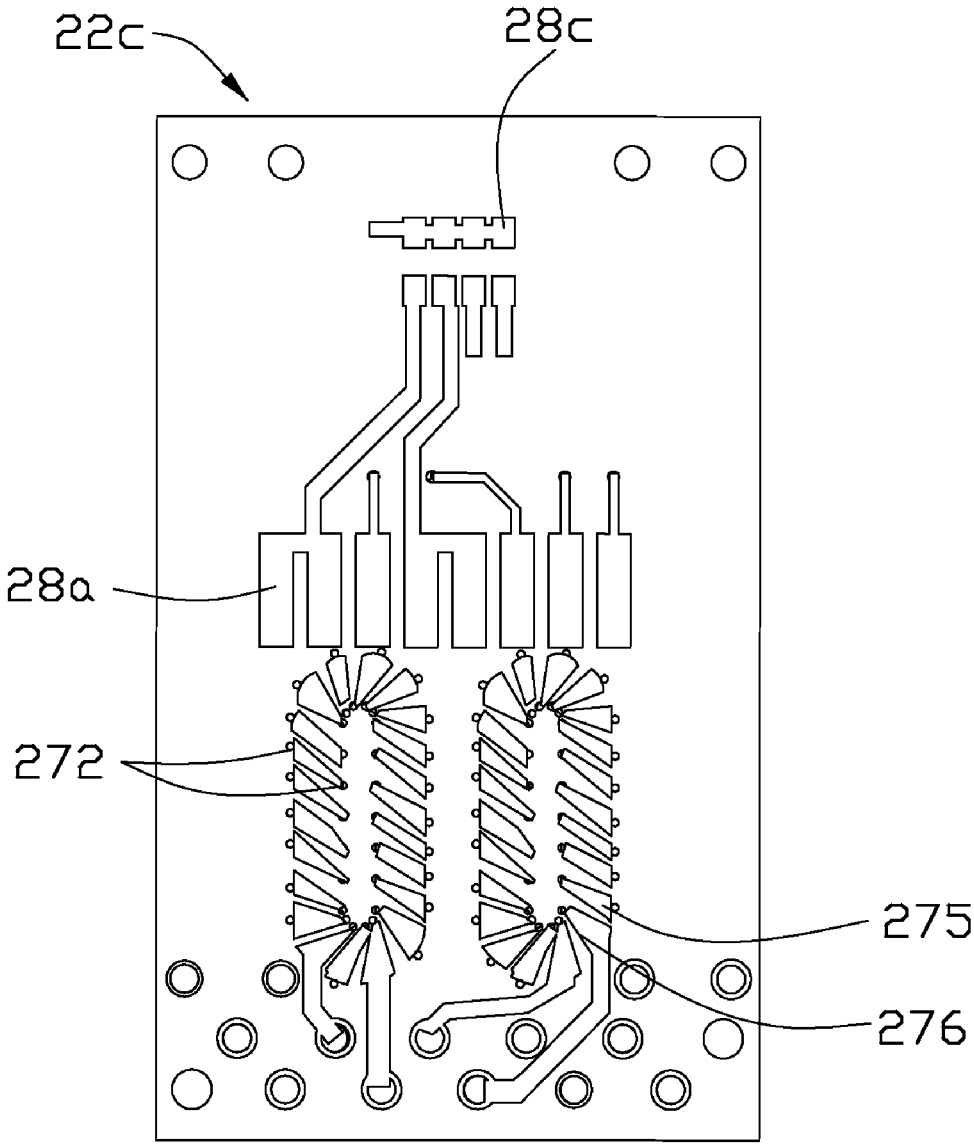
FIG. 6 is a schematic view showing a second conductive layer of the paddle board.

Reference will now be made in detail to the preferred embodiment of the present invention. Referring to FIG. 2, a modular jack connector 100 comprises an insulative housing 1, a contact module 2, a plurality of USB terminals 3, a pair of LEDs 4, and a shielding shell 5 having a first and a second shielding shells 51, 52.

Figure 1:
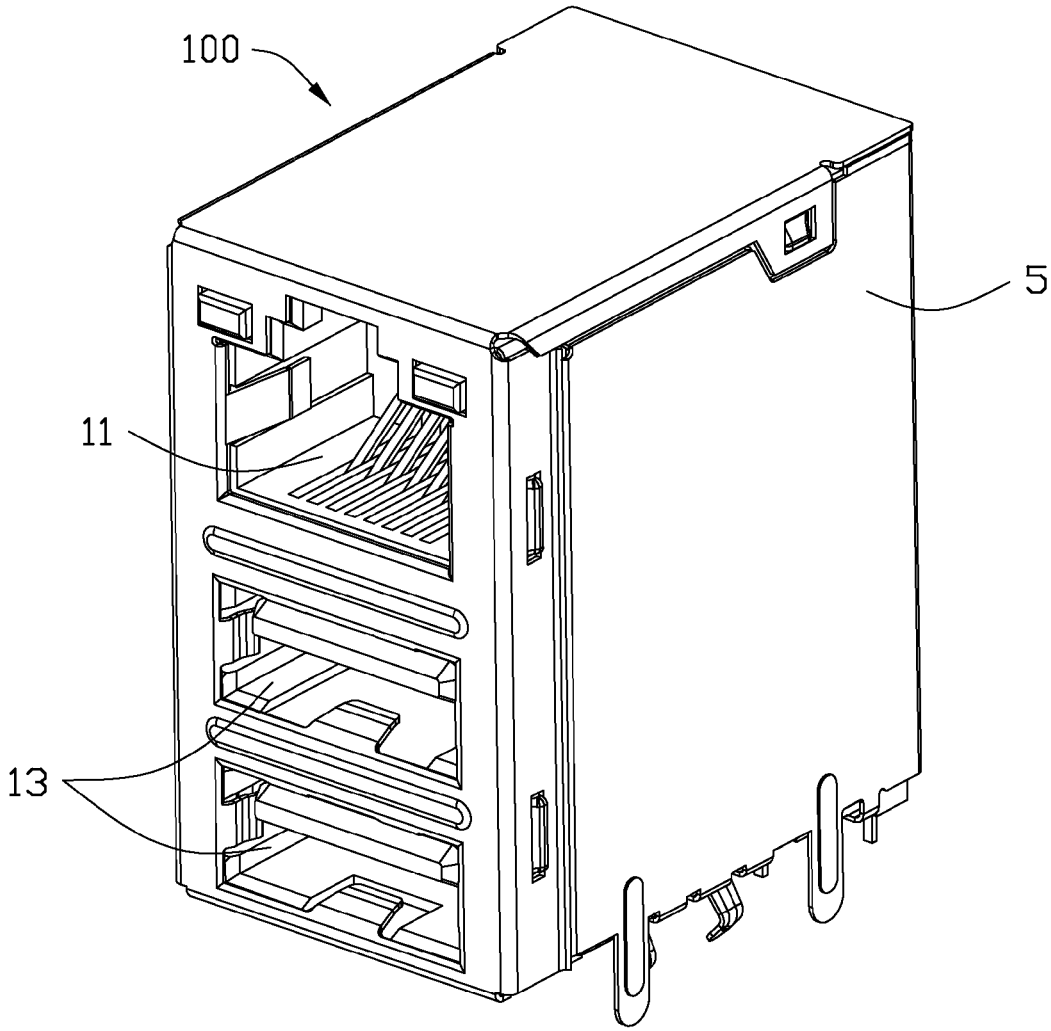
FIG. 1 is an assembled perspective view showing a modular jack connector in accordance with the present invention.

Referring to FIGS. 1-2, the insulative housing 1 defines a receiving port 13, a cavity 12 stacked above the receiving port 13 and a pair of inserting recesses 11 defined above the cavity 12. The receiving port 13 has the plurality of USB terminals 3 received therein.

Referring to FIGS. 2-7, the contact module 2 comprises a paddle board 22, a plurality of contact terminals 21, and a converting module 23 respectively mounted at opposite sides of the paddle board 22. The paddle board 22 has a first conductive layer 22*a*, an opposite second conductive layer 22*c*, and an insulative layer 22*b* sandwiched between the first and second conductive layers 22*a*, 22*c*. The contact module 2 further includes a pair of transformers 27 embedded in the paddle board 22, a pair of common mode chokes 24 and a capacitor 26 mounted on the first conductive layer 22*a* of the paddle board 22, and a resistor 25 mounted on the second conductive layer 22*c*.

Referring to FIGS. 3-7, the first conductive layer 22*a* of the paddle board 22 has a second and a fourth conductive pads 28*b*, 28*d* and a plurality of traces 30 disposed thereon. The second conductive layer 22*b* of the paddle board 22 has a plurality of first conductive pads 28*a*, a third conductive pad 28*c* and a plurality of traces 30 disposed thereon. The paddle board 22 further includes a plurality of upper conductive holes 29*a* and a plurality of lower conductive holes 29*b* defined at upper and lower portions of the paddle board 22 and extending through the paddle board 22.

Figure 7:
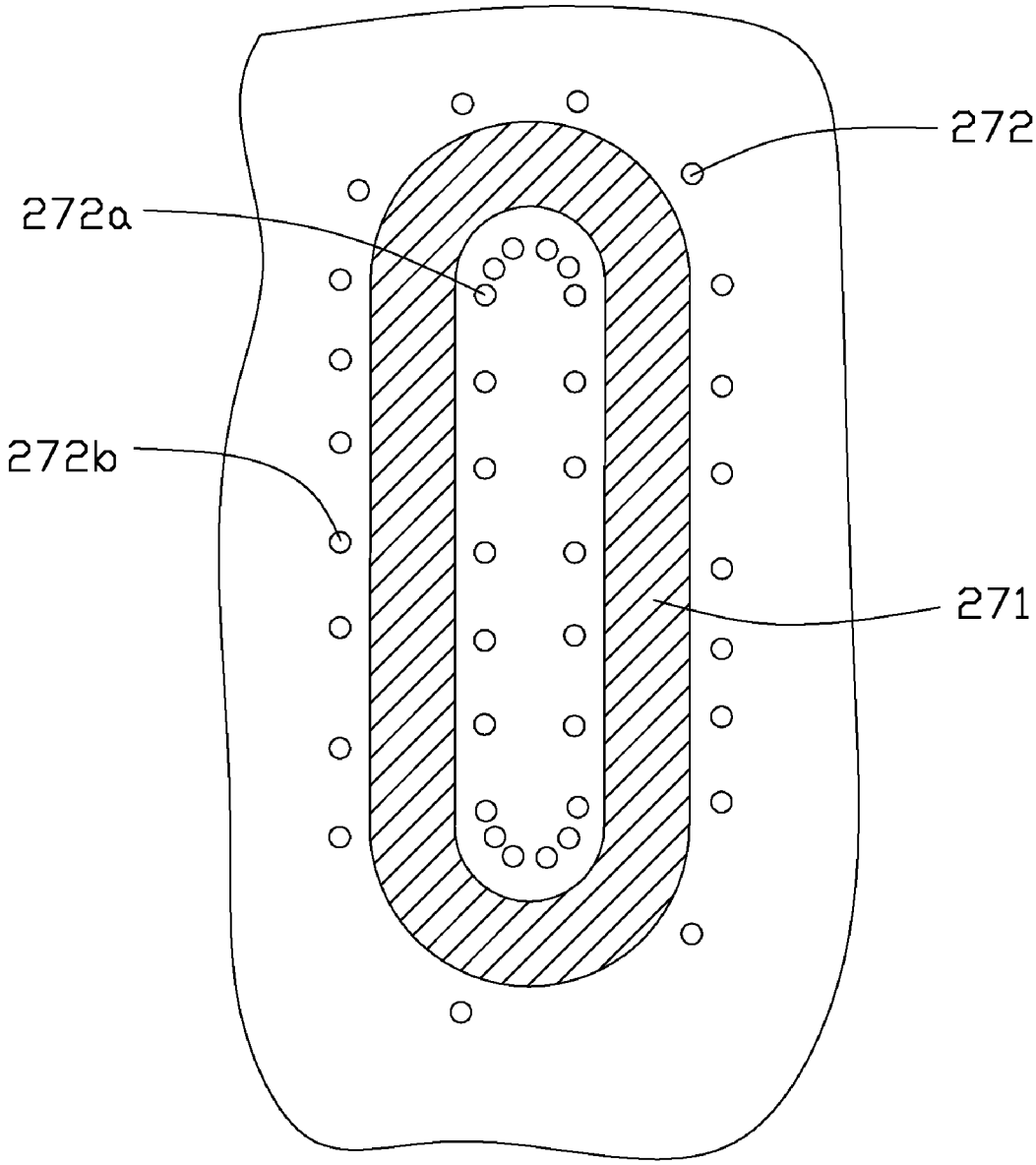
FIG. 7 is a partially cross-sectional view of an insulative layer of the paddle board.

Referring to FIG. 7, the transformer 27 comprises an annular magnetic core 271 embedded in the insulative layer 22*b*, and a plurality of through holes 272 extending through the insulative layer 22*b*. Each through hole 272 extends to the first and second conducive layers 22*a*, 22*c*. The through holes 272 categorized into a plurality of inner through holes 272*a* distributed along the inner diameter of the magnetic core 271 and a plurality of outer through holes 272*b* distributed along the outer diameter of the magnetic core 271.

The transformer 27 includes a first set of primary pads 273 and a first set of secondary pads 274 alternately disposed in the first conductive layer 22*a*, a second set of primary pads 275 and a second set of secondary pads 276 alternately disposed in the second conductive layer 22*c*. The inner through holes 272*a* are connected with the first set and second set of primary pads 273, 275, and the outer through holes 272*b* are connected with the first set and second set of primary pads 273, 275 to constitute a primary coil of the transformer 27. Similarly, the inner through holes 272*a* are connected with the first set and second set of secondary pads 274, 276, and the outer through holes 272*b* are connected with the first set and second set of secondary pads 274, 276 to constitute a secondary coil of the transformer 27.

The plurality of traces 30 comprises a first group of traces connected to the transformers 27 and the second conductive pads 28*b*, a second group of traces connected to the transformers 27 and the lower conductive holes 29*b*, a third group of traces radiating from the transformers 27 and extending to a position adjacent to the fourth conductive pad 28*d*. The first conductive pads 28*a* are electrically connected with the third conductive pads 28*c*.

Referring to FIG. 2, each contact terminal 21 includes an oblique contact portion 211, a vertical soldering portion 212 and a horizontal intermediate portion 213 between the contact portion 211 and the soldering portion 212.

The converting module 23 comprises a body portion 231 and a plurality of L-shaped converting terminals 232 secured to the body portion 231.

In assembling of the contact terminal 2, when the transformer 27 are imbedded in the paddle board 22, the common mode chokes 24 are soldered on the second conductive pads 28*b*. The capacitor 26 is surface mounted on the fourth conductive pad 28*d*. The resistor 25 is soldered on the third conductive pad 28*c*. The contact terminals 21 are soldered on the first conductive pads 28*a*. The converting module 23 is secured to the paddle board 22, with the converting terminals 252 inserting through the lower conductive holes 29*b*. The traces 30 are therefore connected to the transformer 27, the common mode chokes 24, the resistor 25 and the capacitor 26 to constitute a filter circuit to reduce the noise interference.

In assembling of the electrical connector 100, the contact module 2 is assembled to the insulative housing 1, with the contact portions 211 of the contacts 22 retained in the cavity 12.

The pair of LEDs 3 are mounted in the inserting recesses 11 and the upper conductive holes 29*a*. The plurality of USB terminals 3 are secured in the receiving port 13. The first and second shielding shells 51, 52 are mounted on the insulative housing 1.

The transformers 27 are embedded in the paddle board 22 via PCB layout traces 272-276, 30 to improve filter effect. The common mode chokes 24 are surface mounted on the paddle board 22 to save space. The filter circuit capable of reducing noise interference has been established in the modular jack connector 100 only via the paddle board 22 only. Such a contact module 2 has a simple configuration, takes less space and is able to obtain improved characteristics.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack connector comprising:

an insulative housing defining a receiving cavity;

a contact module received in the receiving cavity of the insulative housing, said contact module comprising:

a paddle board having opposite first and second conductive layers and an insulative layer sandwiched between the first and second conductive layers, said first conductive layer being formed with at least one conductive section, said paddle board defining a plurality of vias extending therethrough; and at least one transformer comprising a magnetic core embedded in the paddle board, and a plurality of PCB layout traces distributed in the paddle board and comprising a first group of PCB layout traces having one group of tips extending to a position adjacent to corresponding magnetic core to form a magnetic field and another group of tips connected to the conductive section, and a second group of PCB layout traces having one group of tips extending to a position adjacent to corresponding magnetic core to form a magnetic field and another group of tips connected to the vias;

at least one common mode choke surface mounted on the conductive section;

a plurality of contact terminals attached to the second conductive layer of the paddle board; and a converting module secured to the first conductive layer of the paddle board and having a plurality of converting terminals inserting through said vias.

2. The modular jack connector as claimed in claim 1, wherein there are two transformers, and there are two conductive sections formed on the first conductive layer of the paddle board, and there are two common mode chokes surface mounted on the two conductive sections respectively.

3. The modular jack connector as claimed in claim 2, wherein said second conductive layer of the paddle board is formed with a plurality of first conductive pads for soldering the contact terminals, and a third conductive pad electrically connected with the first conductive pads, said contact module comprising a resistor soldered on the third conductive pad.

4. The modular jack connector as claimed in claim 3, wherein said first conducive layer of the paddle board is formed with a fourth conductive pad, said PCB layout traces comprising a third group of PCB layout traces radiating from the magnetic core and extending to a position adjacent to the fourth conductive pad, said contact module comprising a capacitor soldered on the fourth conductive pad.

5. An electrical connector assembly comprising:

an insulative housing;

a plurality of contacts disposed in the housing;

a paddle board having opposite first and second conductive layers, an insulative layer sandwiched between the first and second conductive layers, and a plurality of vias extending through the first and second conductive layers, and the first conductive layer forming a conductive section thereon;

a common mode choke surface mounted on the conductive section; and a transformer comprising at least one loop type magnetic core embedded in the paddle board, and a plurality of PCB layout traces arranged in each of the first and second conductive layers of the paddle board along the magnetic core under condition that each of said layout traces intersects the magnetic core and is essentially oblique thereto so as to form a pseudo winding and further a pseudo magnetic field; wherein at least one of said PCB layout traces connects to the conductive section.

6. The electrical connector assembly as claimed in claim 5, wherein the PCB layout traces on the first conductive layer extend in an oblique direction similar to that along which the PCB layout traces extend on the second conductive layer.

7. The electrical connector assembly as claimed in claim 5, wherein said transformer comprises a plurality of through holes extending through the insulative layer and extending to the first and second conducive layers.

8. The electrical connector assembly as claimed in claim 7, wherein said through holes are categorized into a plurality of inner through holes distributed along an inner diameter of the magnetic core and a plurality of outer through holes distributed along an outer diameter of the magnetic core.

9. The electrical connector assembly as claimed in claim 8, wherein said PCB layout traces include a first set of primary pads and a first set of secondary pads alternately disposed in the first conductive layer, and a second set of primary pads and a second set of secondary pads alternately disposed in the second conductive layer.

10. The electrical connector assembly as claimed in claim 9, wherein said inner and outer through holes are connected with the first set and second set of primary pads to constitute a primary coil of the transformer.

11. The electrical connector assembly as claimed in claim 9, wherein said inner and outer through holes are connected with the first set and second set of secondary pads to constitute a secondary coil of the transformer.

* * * * *